US008591082B2

(12) United States Patent
Otani

(10) Patent No.: US 8,591,082 B2
(45) **Date of Patent: *Nov. 26, 2013**

(54) VEHICLE LAMP UNIT

(75) Inventor: Tomoaki Otani, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 176 days.

This patent is subject to a terminal disclaimer.

(21) Appl. No.: 13/178,226

(22) Filed: Jul. 7, 2011

(65) Prior Publication Data

US 2012/0008333 A1 Jan. 12, 2012

(30) Foreign Application Priority Data

Jul. 8, 2010 (JP) ..... 2010-156070

(51) Int. Cl.
*F21V 7/00* (2006.01)

(52) U.S. Cl.
USPC ..... 362/516; 362/521; 362/538; 362/327; 362/311.02

(58) Field of Classification Search
USPC ..... 362/516, 517, 518, 311.11, 297, 298, 362/304, 302, 538, 521, 522, 327, 311.02, 362/311.07
See application file for complete search history.

(56) References Cited

U.S. PATENT DOCUMENTS 7,070,312 B2 * 7/2006 Tatsukawa ..... 362/545
2004/0257826 A1 12/2004 Tatsukawa
2005/0057940 A1 * 3/2005 Capello et al. ..... 362/507
2006/0109669 A1 * 5/2006 Tanaka et al. ..... 362/459
2008/0094852 A1 * 4/2008 King et al. ..... 362/516
2009/0290371 A1 * 11/2009 Yagi ..... 362/518
2012/0057363 A1 * 3/2012 Ishida et al. ..... 362/516

FOREIGN PATENT DOCUMENTS

| | | | |
|---|---|---|---|
| CN | 1637340 | A | 7/2005 |
| EP | 2172694 | A1 | 4/2010 |
| EP | 2202454 | A2 | 6/2010 |
| JP | 2005-011704 | A | 1/2005 |
| JP | 2008078086 | A | 4/2008 |

OTHER PUBLICATIONS

Office Action Issued in Chinese Application No. 201110193751.6, Dated May 24, 2013 (18 Pages with English Translation).

* cited by examiner

*Primary Examiner* — Jason Moon Han
*Assistant Examiner* — Jessica M Apenteng
(74) *Attorney, Agent, or Firm* — Osha Liang LLP

(57) ABSTRACT

A vehicle lamp unit has a light emitting device disposed adjacent to a base point on an optical axis extending in a front-rear direction of a vehicle on which the vehicle lamp unit is mounted, and a transparent member disposed in front of the light emitting device. The light emitting device has a light emitting surface arranged to face forward. The transparent member is configured such that light emitted by the light emitting device enters the transparent member and is internally reflected by a front surface of the transparent member, and such that the light reflected by the front surface is internally reflected again by a rear surface of the transparent member and emitted from the front surface of the transparent member. The front surface has a flat surface facing obliquely upward.

6 Claims, 8 Drawing Sheets

R1
R2
R3
Z1i
Z1o
Z1
C1

R4
R5
R6
Z1i
Z1o
Z1
C1

R7
R8
R9
Z1i
Z1o
Z1
C1

CL2
CL1
E
V
V
H
H
I1
I2
I3

CL2
CL1
E
V
V
H
H
I4
I5
I6

CL2
CL1
E
V
V
H
H
I7
I8
I9

VEHICLE LAMP UNIT

CROSS-REFERENCE TO RELATED APPLICATIONS

The present application claims priority from Japanese Patent Application No. 2010-156070 filed on Jul. 8, 2010, the entire content of which is incorporated herein by reference.

BACKGROUND OF INVENTION

1. Field of the Invention

The present invention relates to a vehicle lamp unit configured such that light from a light emitting device is emitted forward from a transparent member disposed in front of the light emitting device.

2. Related Art

A related art lamp unit has a light emitting device disposed adjacent to a point on an optical axis extending in the front-rear direction of a vehicle. The light emitting device is arranged such that its light emitting surface faces forward. The light from the light emitting device is emitted forward from a transparent member disposed in front of the light emitting device (see, e.g., JP 2005-11704 A).

More specifically, the light emitted from the light emitting device entered the transparent member is internally reflected by the front surface of the transparent member. The light reflected by the front surface is internally reflected again by the rear surface of the transparent member, and is emitted from another portion of the front surface. The central area of the front surface of the transparent member has a mirrored surface to internally reflect the light from the light emitting device.

According to this configuration, a slim headlamp can be provided. Further, by arranging the light emitting device such that the bottom side edge of the light emitting surface of the light emitting device is disposed on and along the horizontal line perpendicular to the optical axis, a light distribution pattern having a horizontal cutoff line at its upper end can be formed.

However, the related art lamp unit can only form a linear cutoff line extending in a single direction.

Therefore, to provide a headlamp capable of forming a low beam light distribution pattern, a lamp unit for forming a horizontal cutoff line and a lamp unit for forming an oblique cutoff line are used together.

Further, the front surface of the transparent member is flat and is perpendicular to the optical axis. Therefore, when arranging the related art lamp unit in a headlamp having a rearwardly slanted transparent cover, the layout of the lamp unit inside the headlamp is limited to the extent that the perpendicular front surface of the transparent member does not hit the transparent cover in front.

SUMMARY OF INVENTION

One or more embodiments of the present invention provides a vehicle lamp unit configured to form a low beam light distribution pattern and to improve flexibility of a layout of the lamp unit.

According to one or more embodiments of the present invention, a vehicle lamp unit is provided. The vehicle lamp unit includes a light emitting device disposed adjacent to a base point on an optical axis extending in a front-rear direction of a vehicle on which the vehicle lamp unit is mounted, and a transparent member disposed in front of the light emitting device. The light emitting device includes a light emitting surface arranged to face forward. The transparent member is configured such that light emitted from the light emitting device and entered the transparent member is internally reflected by a front surface of the transparent member, and such that the light reflected by the front surface is internally reflected again by a rear surface of the transparent member and is emitted from the front surface of the transparent member. The light emitting surface includes a straight bottom side edge disposed on and along a horizontal line perpendicular to the optical axis. The front surface of the transparent member includes a flat surface facing obliquely upward and including another horizontal line perpendicular to the optical axis. The rear surface of the transparent member includes a light reflection control surface configured based on a paraboloidal reference surface having a focal point at a position symmetric with the base point with respect to the flat surface and having a center axis directed forward and inclined upward with respect to the optical axis. A central area of the front surface having a range centered at the optical axis is a mirrored surface. The light reflection control surface is a mirrored surface. The light reflection control surface includes a first zone positioned obliquely downward on an ongoing lane side with respect to the optical axis. The first zone is divided into an inner zone and an outer zone by a curve line, the curve line being convex toward the optical axis when observed from a front of the vehicle. The inner zone is configured to reflect light to form an oblique cutoff line extending obliquely upward on the ongoing lane side.

The specific shape and size of the light emitting surface of the above-mentioned light emitting device is not limited in particular, provided that the bottom side edge of the light emitting surface extends linearly. Further, the position of the light emitting device in the left-right direction is not limited in particular, provided that the bottom side edge of the light emitting surface thereof is positioned on and along horizontal line perpendicular to the optical axis. Furthermore, the light emitting surface of the light emitting device may face directly forward of the lamp or may be tilted upward or downward with respect to the front direction of the lamp while still facing forward.

The specific shape of the light reflection control surface configured based on a paraboloidal reference surface is not limited in particular. For example, the light reflection control surface may be formed on and along the paraboloidal surface, may include a plurality of reflective elements formed the on paraboloidal reference surface, or may be formed by deforming the paraboloidal surface.

The mirrored surface may be formed by surface treatment, such as aluminum deposition, or by attaching a mirror surface sheet.

Still further, the mirrored surface may be provided on the entire area of the rear surface of the transparent member or may not be provided on an area located at a position where the internally light reflected by the front surface of the transparent member is totally reflected.

Other aspects and advantages of the invention will be apparent from the following description, the drawings and the claims.

DETAILED DESCRIPTION

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
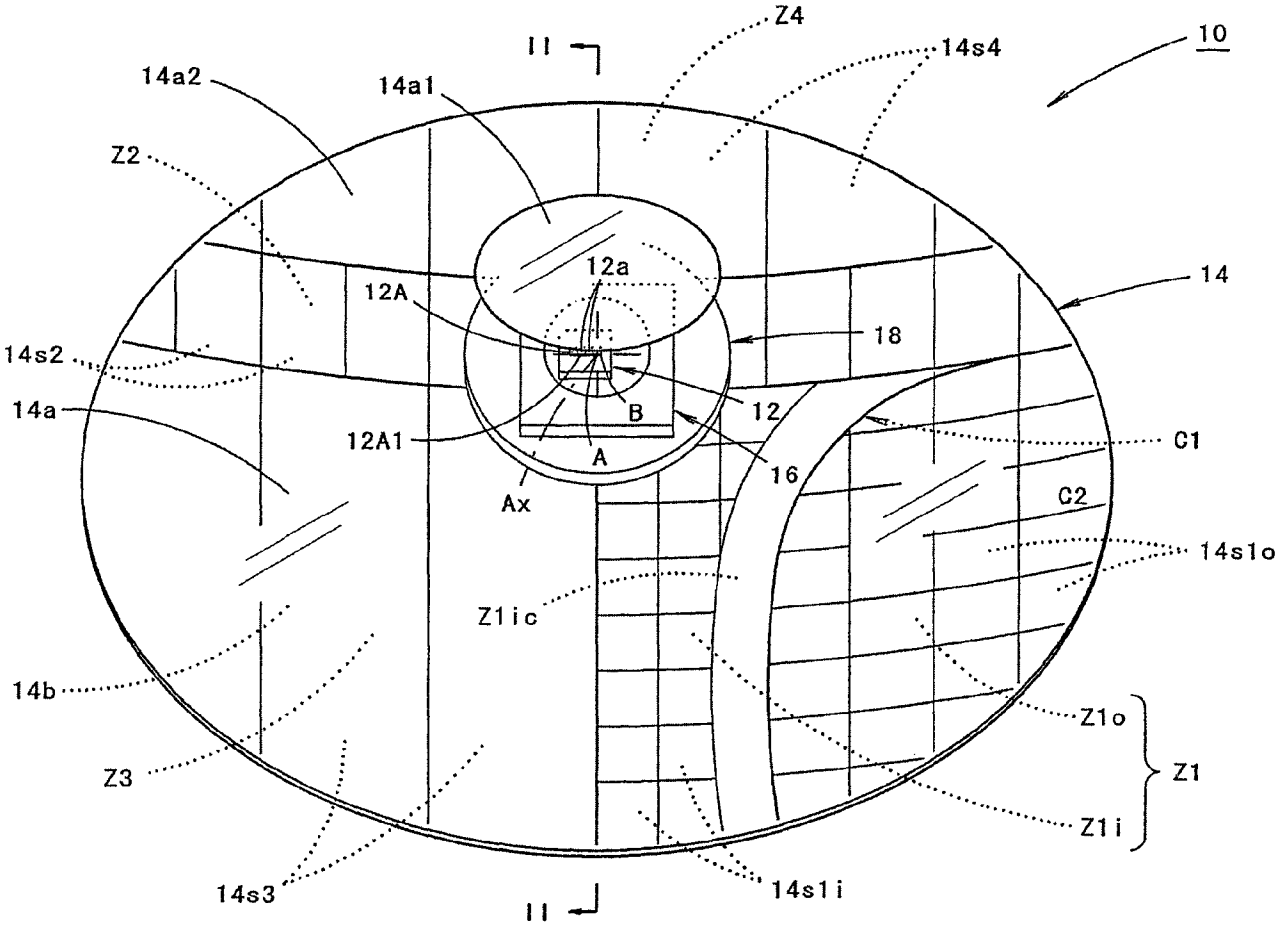
FIG. 1 is a front view of a vehicle lamp unit according to one or more embodiments of the present invention.
Figure 2:
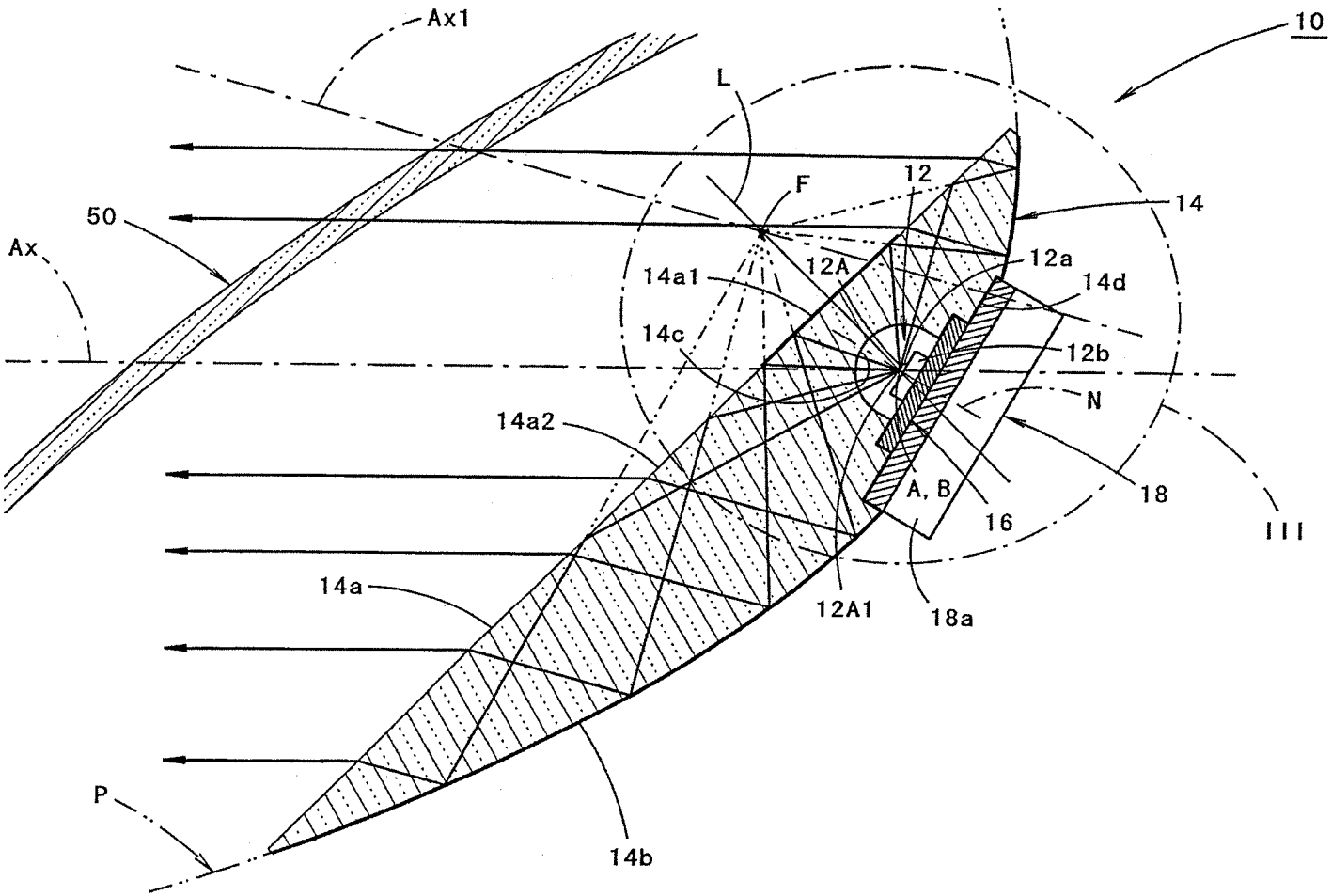
FIG. 2 is a sectional view taken along the line II-II of FIG. 1.
Figure 3:
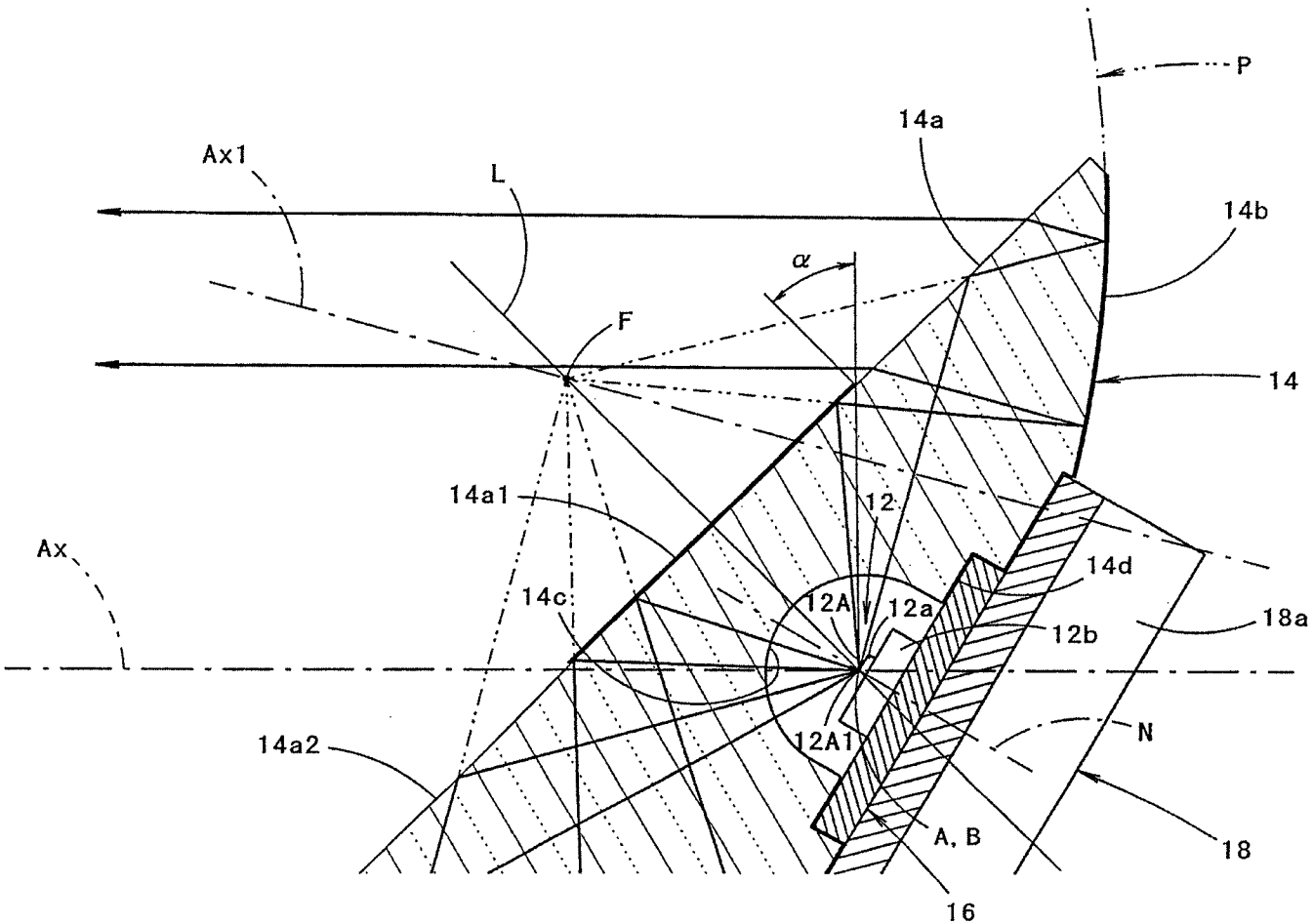
FIG. 3 is an enlarged view of the portion III of FIG. 2.

As shown in FIGS. 1 to 3, a vehicle lamp unit 10 according to one or more embodiments of the present invention includes a light emitting device 12 disposed adjacent to a base point A on an optical axis Ax extending in the front-rear direction of the lamp, a transparent member 14 disposed in front of the light emitting device 12, a support plate 16 made of a metal, for supporting the light emitting device 12, and a heat sink 18 made of a metal and secured to the rear surface of this support plate 16. The light emitting device 12 is arranged such that the light emitting surface 12A of the light emitting device 12 faces forward.

Figure 4:
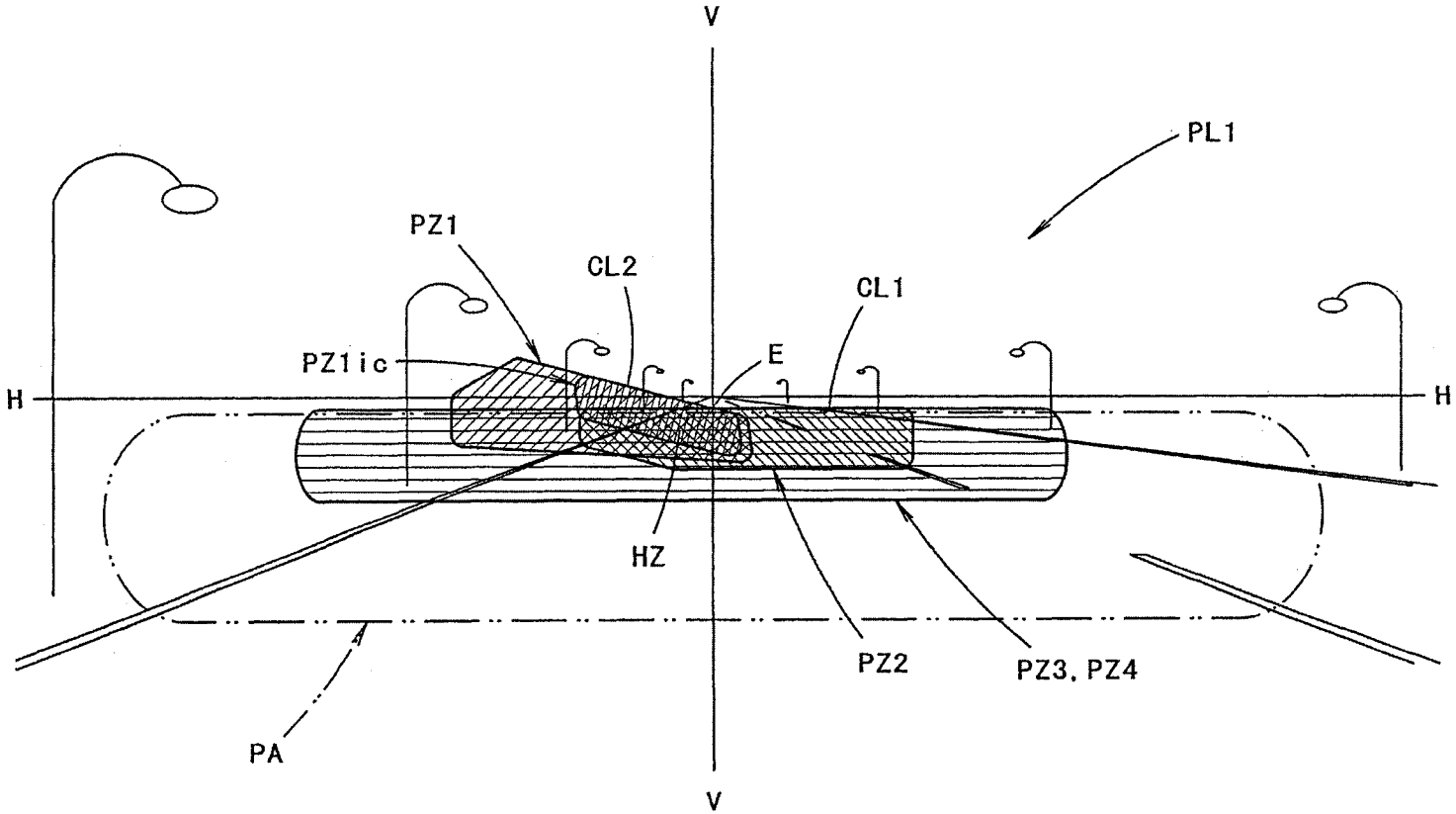
FIG. 4 is a diagram illustrating a low beam light distribution pattern formed on an imaginary vertical screen disposed 25 m ahead of the lamp by the light emitted forward from the lamp unit.

This vehicle lamp unit 10 is designed so as to be used in a state of being incorporated in a lamp body or the like (not shown) so that the optical axis thereof can be adjusted with respect thereto. In the state in which the optical axis adjustment is completed, the optical axis Ax extends forward of a vehicle while being inclined downward about 0.5° to 0.6°. In addition, such a left low beam light distribution pattern PL1 as shown in FIG. 4 is formed by irradiation light from the vehicle lamp unit 10.

The transparent cover 50 of a headlamp in which the lamp unit 10 is incorporated is formed so as to extend while being inclined significantly backward and upward along the design line of the upper surface of the front end section of the vehicle body as shown in FIG. 2.

The light emitting device 12 is a white light-emitting diode formed of four light emitting chips 12*a* disposed in series in the horizontal direction and a substrate 12*b* for supporting these light emitting chips.

The four light emitting chips 12*a* are disposed so as to make nearly close contact with one another and the front surfaces thereof are sealed with a thin film, whereby a light emitting surface 12A for emitting light having a laterally-long rectangular shape when observed from the front of the lamp is formed. Since each of the light emitting chips 12*a* has an external shape (square) of about 1×1 mm, the light emitting surface 12A has an external shape of about 1×4 mm.

The bottom side edge 12A1 of the light emitting surface 12A of the light emitting device 12 is positioned on and along a horizontal line perpendicular to the optical axis Ax at the base point A. The end point B of the bottom side edge 12A1 on the ongoing lane side (on the right side when observed from the front of the lamp) is disposed at a position on the ongoing lane side from the optical axis Ax and near the optical axis Ax (e.g., at a position away from the optical axis Ax by about 0.3 mm to 1.0 mm). The light emitting device 12 is disposed such that the normal line N of the light emitting surface 12A passing through the base point A is inclined forward and upward by about 30°.

The transparent member 14 is made of a transparent synthetic resin molded product, such as an acrylic resin molded product, and has a circular external shape when observed from the front of the lamp. The outside diameter of the transparent member 14 is about 100 mm. Furthermore, the transparent member 14 is configured such that the light emitted from the light emitting device 12 enters the transparent member 14 and is internally reflected by the front surface 14*a* thereof, and the reflected light is internally reflected again by the rear surface 14*b* thereof and is emitted forward from the front surface 14*a* thereof.

The front surface 14*a* of the transparent member 14 is a flat surface facing obliquely upward and including the horizontal line perpendicular to the optical axis Ax. The front surface 14*a* is inclined by about 45° rearward with respect to a plane perpendicular to the optical axis Ax.

Furthermore, the central area 14*a*1 of the front surface 14*a* of the transparent member 14 is subjected to mirror finishing by aluminum deposition, for example. When it is assumed that a position symmetric with the base point A with respect to the front surface 14*a* is set as a focal point F (described later), the central area 14*a*1 is an area defined as a nearly circular area centered at the intersection of the front surface 14*a* and a straight line L connecting the focal point F and the base point A and is displaced upward from the center position of the front surface 14*a*.

The outer circumference of the central area 14*a*1 is set at a position where the incident angle of the light emitted from the light emitting device 12 (to be more exact, the light from the base point A) and having reached the front surface 14*a* of the transparent member 14 becomes equal to the critical angle $\alpha$ of the transparent member 14. Hence, the light emitted from the light emitting device 12 and having reached the front surface 14*a* of the transparent member 14 is internally reflected by the mirror-finished reflecting surface of the central area 14*a*1 and is totally reflected internally in a peripheral area 14*a*2 positioned on the outer circumferential side of the central area 14*a*1.

On the other hand, the rear surface 14*b* of the transparent member 14 includes a light reflection control surface configured based on a paraboloidal reference surface P having a focal point F at the position plane-symmetric with the base point A with respect to the front surface 14*a* and having a center axis Ax1 coincident with an axial line extending upward and forward at an angle of about 15° with respect to the optical axis Ax. Furthermore, the entire surface of the rear surface 14*b*, except for the area around the normal line N, is subjected to mirror finishing by aluminum deposition, for example.

The upward angle of the center axis Ax1 of the paraboloidal reference surface P is set to a value so that when it is assumed that the rear surface 14*b* of the transparent member 14 is formed on and along the paraboloidal reference surface P, the light from the base point A, which is reflected again by the rear surface 14*b* in a direction parallel with the center axis Ax1, is refracted at the front surface 14*a* and emitted in a direction parallel with the optical axis Ax.

The rear surface 14*b* of the transparent member 14 is formed so as to annularly enclose the normal line N. A cavity 14*c* enclosing the light emitting device 12 is formed on the inner circumferential side of the rear surface 14*b* at the center thereof. A step-shaped recess portion 14*d* is formed around this cavity 14*c*.

The cavity 14*c* is formed into a semispherical shape centered at the base point A. Hence, the light emitted from the light emitting device 12 (to be more exact, the light emitted from the base point A) enters the transparent member 14 without being refracted. Furthermore, the step-shaped recess portion 14*d* has a shape conforming to the shapes of the support plate 16 and the heat sink 18 so as to position and fasten these components. The heat sink 18 is configured so as to have a plurality of heat dissipating fins 18*a* formed on the rear surface thereof.

Next, the specific configuration of the rear surface 14*b* of the transparent member 14 serving as the light reflection control surface will be described below.

As shown in FIG. 1, the rear surface 14*b* of the transparent member 14 is formed of a first zone Z1 positioned obliquely downward on the ongoing lane side with respect to the optical axis Ax; a second zone Z2 positioned on a horizontal plane including the optical axis Ax on the lateral sides of the rear surface on the ongoing lane side and the oncoming lane side with respect to the optical axis Ax; a third zone Z3 positioned obliquely downward on the oncoming lane side with respect to the optical axis Ax; and a fourth zone Z4 positioned above the second zone Z2.

The first zone Z1 is divided into an inner zone Z1*i* and an outer zone Z1*o* by a curve line C1 that is convex toward the optical axis Ax when observed from the front of the lamp is used as a boundary.

The curve line C1 is formed by, assuming that the rear surface 14*b* of the transparent member 14 is formed on and along the paraboloidal reference surface P, connecting specific positions so that the light source image of the light emitting surface 12A of the light emitting device 12, formed by the light reflected by the paraboloidal reference surface P, becomes a light source image having an upper line extending obliquely upward at an inclination angle of 15° toward the ongoing lane side. The curve line C1 can be approximated to a hyperbolic curve centered at the optical axis Ax when observed from the front of the lamp.

In other words, the portion of the curve line C1 that is closest to the optical axis Ax is positioned approximately at the middle between the inner circumferential edge and the outer circumferential edge of the rear surface 14*b* of the transparent member 14. The end point on the lower end side, intersecting the outer circumferential edge of the rear surface 14*b*, is positioned slightly away from the vertical plane including the optical axis Ax to the ongoing lane side. Furthermore, the end point on the upper end side, intersecting the outer circumferential edge of the rear surface 14*b*, is positioned downward slightly away from the horizontal plane including the optical axis Ax. Moreover, the curve line C1 has the largest curvature where it is closest to the optical axis Ax. The curvature of the curve line C1 becomes gradually smaller as it extends to the end point on the upper end side and to the end point on the lower end side.

The zone Z1*ic* of the inner zone Z1*i* of the first zone Z1 adjacent to the curve line C1, i.e., a band-like zone extending along the curve line C1, is formed on and along the paraboloidal reference surface P, and the other zones of the inner zone Z1*i* includes a plurality of deflective reflecting-elements 14*s*1*i* formed on the paraboloidal reference surface P. The width of the zone Z1*ic* adjacent to the curve line C1 is about 5 mm to 20 mm.

Furthermore, the zone Z1*ic* of the inner zone Z1*i* adjacent to the curve line C1 is designed so that the internally reflected light entering from the front surface 14*a* to the zone Z1*ic* is reflected in the direction parallel with the optical axis Ax. Each of the deflective reflecting-elements 14*s*1*i* of the other zones of the inner zone Z1*i* is designed so that the internally reflected light entering from the front surface 14*a* to the other zones is deflected and reflected to the ongoing lane side with respect to the direction parallel with the optical axis Ax.

On the other hand, the outer zone Z1*o* of the first zone Z1 includes a plurality of deflective reflecting-elements 14*s*1*o* formed on the paraboloidal reference surface P. Each of the deflective reflecting-elements 14*s*1*o* of the outer zone Z1*o* is designed so that the internally reflected light entering from the front surface 14*a* to the zone is deflected and reflected to the ongoing lane side in the direction parallel with the optical axis Ax.

The second zone Z2 extends in a laterally long band-like shape centered at the horizontal plane including the optical axis Ax. The vertical width of the second zone Z2 is about 5 mm to 20 mm.

The second zone Z2 includes a plurality of deflective reflecting-elements 14*s*2 formed on the paraboloidal reference surface P. Each of the deflective reflecting-elements 14*s*2 of the second zone Z2 is designed so that the internally reflected light entering from the front surface 14*a* to the zone is deflected and reflected to the oncoming lane side with respect to the direction parallel with the optical axis Ax.

The third zone Z3 includes a plurality of diffusive reflecting-elements 14*s*3 formed on the paraboloidal reference surface P. Each of the diffusive reflecting-elements 14*s*3 of the third zone Z3 is designed so that the internally reflected light entering from the front surface 14*a* to the zone is diffused and reflected to both the left and right sides with respect to the direction parallel with the optical axis Ax.

The fourth zone Z4 includes a plurality of diffusive reflecting-elements 14*s*4 formed on the paraboloidal reference surface P. Each of the diffusive reflecting-elements 14*s*4 of the fourth zone Z4 is designed so that the internally reflected light entering from the front surface 14*a* to the zone is diffused and reflected to both the left and right sides with respect to the direction parallel with the optical axis Ax.

FIG. 4 is a perspective view showing the low beam light distribution pattern PL1 formed on an imaginary vertical screen disposed 25 m ahead of the lamp by the light emitted forward from the vehicle lamp unit 10.

The low beam light distribution pattern PL1 is the left low beam light distribution pattern as described above and has horizontal and oblique cutoff lines CL1 and CL2 at the upper end portion thereof. The horizontal cutoff line CL1 is formed on the oncoming lane side with respect to the vertical line V-V passing through a vanishing point H-V ahead of the vehicle. Furthermore, the oblique cutoff line CL2 having an inclination angle of 15° is formed on the ongoing lane side. An elbow point E, the intersection of the two cutoff lines CL1 and CL2, is positioned about 0.5° to 0.6° downward from H-V, and a hot zone HZ serving as a high luminance area is formed in the vicinity of the elbow point E on the ongoing lane side. The elbow point E is positioned about 0.5° to 0.6° downward from H-V because the optical axis Ax of the vehicle lamp unit 10 extends downward about 0.5° to 0.6° with respect to the front direction of the vehicle.

The low beam light distribution pattern PL1 is formed as a synthesized light distribution pattern obtained by superimposing four light distribution patterns PZ1 (including a light distribution pattern PZ1*ic*), PZ2, PZ3 and PZ4.

These light distribution patterns PZ1 to PZ4 are light distribution patterns formed by the light (hereafter referred to as "repeatedly reflected light") emitted after repeatedly reflected by the front surface 14*a* and the rear surface 14*b* of the transparent member 14 and formed by the repeatedly reflected light from the first to fourth zones Z1 to Z4, respectively.

The horizontal cutoff line CL1 of the low beam light distribution pattern PL1 is formed by the upper lines of the light distribution patterns PZ2 to PZ4, and is formed particularly clearly by the upper line of the light distribution pattern PZ2.

Furthermore, the oblique cutoff line CL2 of the low beam light distribution pattern PL1 is formed by the upper line of the light distribution pattern PZ1, and is formed particularly clearly by the upper line of the light distribution pattern PZ1*ic*.

The light distribution patterns PZ1 to PZ4 will be described below in detail.

First, the light distribution pattern PZ1 will be described below.

The light distribution pattern PZ1 is a light distribution pattern having an wedged shape extending along the oblique cutoff line CL2, and its upper line is formed as a clear bright-dark border. The reason for this will be described below referring to FIGS. 5A to 5F.

FIGS. 5A to 5F are diagrams, in the case that the first zone Z1 is formed on and along the paraboloidal surface P, illustrating the light source images of the light emitting surface 12A formed by the repeatedly reflected light from a plurality of positions on the first zone Z1.

Figures 5A, 5B, 5C, 5D, 5E, 5F:
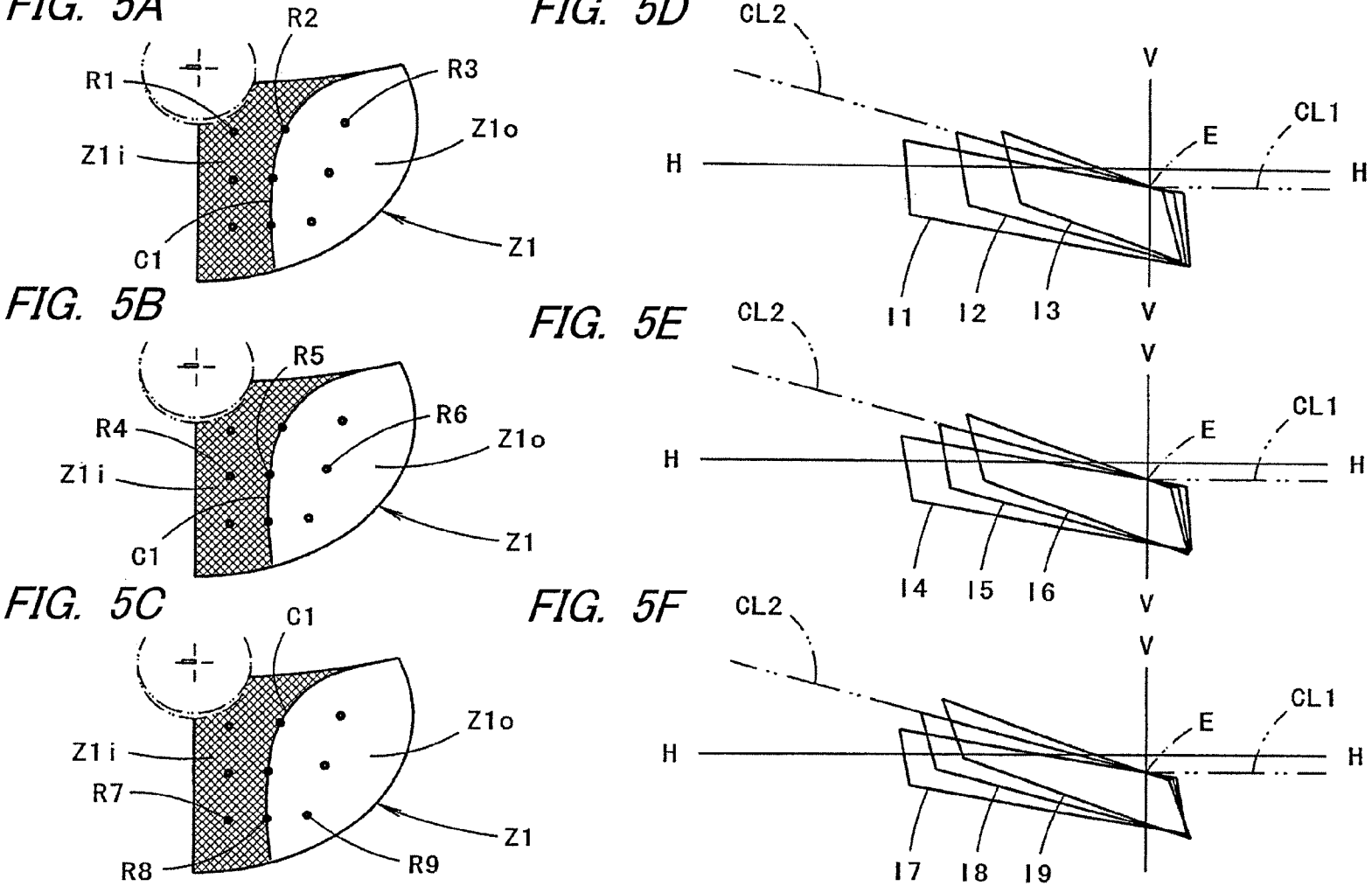
FIGS. 5A to 5F are diagrams illustrating light source images of a light emitting surface of a light emitting device formed by repeatedly reflected light from a plurality of positions on a first zone of the rear surface of a transparent member, assuming that the first zone of the rear surface is a paraboloidal surface.

FIGS. 5A to 5C are front views showing some portions of the first zone Z1. FIG. 5A shows the positions of three reflecting points R1, R2 and R3 in the upper portion of the first zone Z1, FIG. 5B shows the positions of three reflecting points R4, R5 and R6 in the middle portion thereof, and FIG. 5C shows the positions of three reflecting points R7, R8 and R9 in the lower portion thereof.

FIG. 5D is a view showing the light source images I1, I2 and I3 of the light emitting surface 12A formed by the repeatedly reflected light from the positions of the three reflecting points R1, R2 and R3 shown in FIG. 5A.

As shown in FIG. 5D, the light source images I1, I2 and I3 are formed as slender images extending obliquely upward to the subject vehicle side from a position below and in the vicinity of the elbow point E.

The upper lines of these light source images I1 to I3 are formed as the light source image of the bottom side edge 12A1 of the light emitting surface 12A. Since the bottom side edge 12A1 is positioned on and along the horizontal line perpendicular to the optical axis Ax at the base point A, the upper lines of the light source images I1 to I3 are formed as a relatively clear bright-dark border passing through the elbow point E.

Furthermore, the lateral side lines of the light source images I1 to I3 on the oncoming lane side are positioned slightly on the oncoming lane side from the line V-V because the end point B of the bottom side edge 12A1 of the light emitting surface 12A is positioned on the ongoing lane side from the optical axis Ax and near the optical axis Ax.

Moreover, the light source image I1 formed by the repeatedly reflected light from the reflecting point R1 positioned closest to the oncoming lane side becomes a least inclined image. As the reflecting point is displaced from R1 to R2 and R3 to the ongoing lane side, the inclination of the light source image increases gradually from I1 to I2 and I3.

The upper line of the light source image I2 formed by the repeatedly reflected light from the reflecting point R2 positioned on the curve line C1 is inclined at an inclination angle of 15° and coincides with the oblique cutoff line CL2 extending at an inclination angle of 15° from the elbow point E to the ongoing lane side. Furthermore, the upper line of the light source image I1 formed by the repeatedly reflected light from the reflecting point R1 positioned in the inner zone Z1*i* is inclined at an inclination angle of less than 15°. On the other hand, the upper line of the light source image I3 formed by the repeatedly reflected light from the reflecting point R3 positioned in the outer zone Z1*o* is inclined at an inclination angle of more than 15°.

FIG. 5E is a view showing the light source images I4, I5 and I6 of the light emitting surface 12A formed by the repeatedly reflected light from the positions of the three reflecting points R4, R5 and R6 shown in FIG. 5B.

As shown in FIG. 5E, the light source images I4 to I6 are also formed as slender images extending obliquely upward to the subject vehicle side from a position below and in the vicinity of the elbow point E. The upper lines of the light source images I4 to I6 are formed as a relatively clear bright-dark border passing through the elbow point E, and the lateral side lines of the light source images I4 to I6 are positioned slightly on the oncoming lane side from the line V-V.

Moreover, the light source image I4 formed by the repeatedly reflected light from the reflecting point R4 positioned closest to the oncoming lane side becomes a least inclined image. As the reflecting point is displaced from R4 to R5 and R6 to the ongoing lane side, the inclination of the light source image increases gradually from I4 to I5 and I6.

The upper line of the light source image I5 formed by the repeatedly reflected light from the reflecting point R5 positioned on the curve line C1 is inclined at an inclination angle of 15° and coincides with the oblique cutoff line CL2 extending at an inclination angle of 15° from the elbow point E to the ongoing lane side. Furthermore, the upper line of the light source image I4 formed by the repeatedly reflected light from the reflecting point R4 positioned in the inner zone Z1*i* is inclined at an inclination angle of less than 15°. On the other hand, the upper line of the light source image I6 formed by the repeatedly reflected light from the reflecting point R6 positioned in the outer zone Z1*o* is inclined at an inclination angle of more than 15°.

FIG. 5F is a view showing the light source images I7, I8 and I9 of the light emitting surface 12A formed by the repeatedly reflected light from the positions of the three reflecting points R7, R8 and R9 shown in FIG. 5C.

As shown in FIG. 5F, the light source images I7 to I9 are also formed as slender images extending obliquely upward to the subject vehicle side from a position below and in the vicinity of the elbow point E. The upper lines of the light source images I7 to I9 are formed as a relatively clear bright-dark border passing through the elbow point E, and the lateral side lines of the light source images I7 to I9 are positioned slightly on the oncoming lane side from the line V-V.

Moreover, the light source image I7 formed by the repeatedly reflected light from the reflecting point R7 positioned closest to the oncoming lane side becomes a least inclined image. As the reflecting point is displaced from R7 to R8 and R9 to the ongoing lane side, the inclination of the light source image increases gradually from I7 to I8 and I9.

The upper line of the light source image I8 formed by the repeatedly reflected light from the reflecting point R8 positioned on the curve line C1 is inclined at an inclination angle of 15° and coincides with the oblique cutoff line CL2 extending at an inclination angle of 15° from the elbow point E to the ongoing lane side. Furthermore, the upper line of the light source image I7 formed by the repeatedly reflected light from the reflecting point R7 positioned in the inner zone Z1*i* is inclined at an inclination angle of less than 15°. On the other hand, the upper line of the light source image I9 formed by the repeatedly reflected light from the reflecting point R9 positioned in the outer zone Z1*o* is inclined at an inclination angle of more than 15°.

Figures 6A, 6B, 6C:
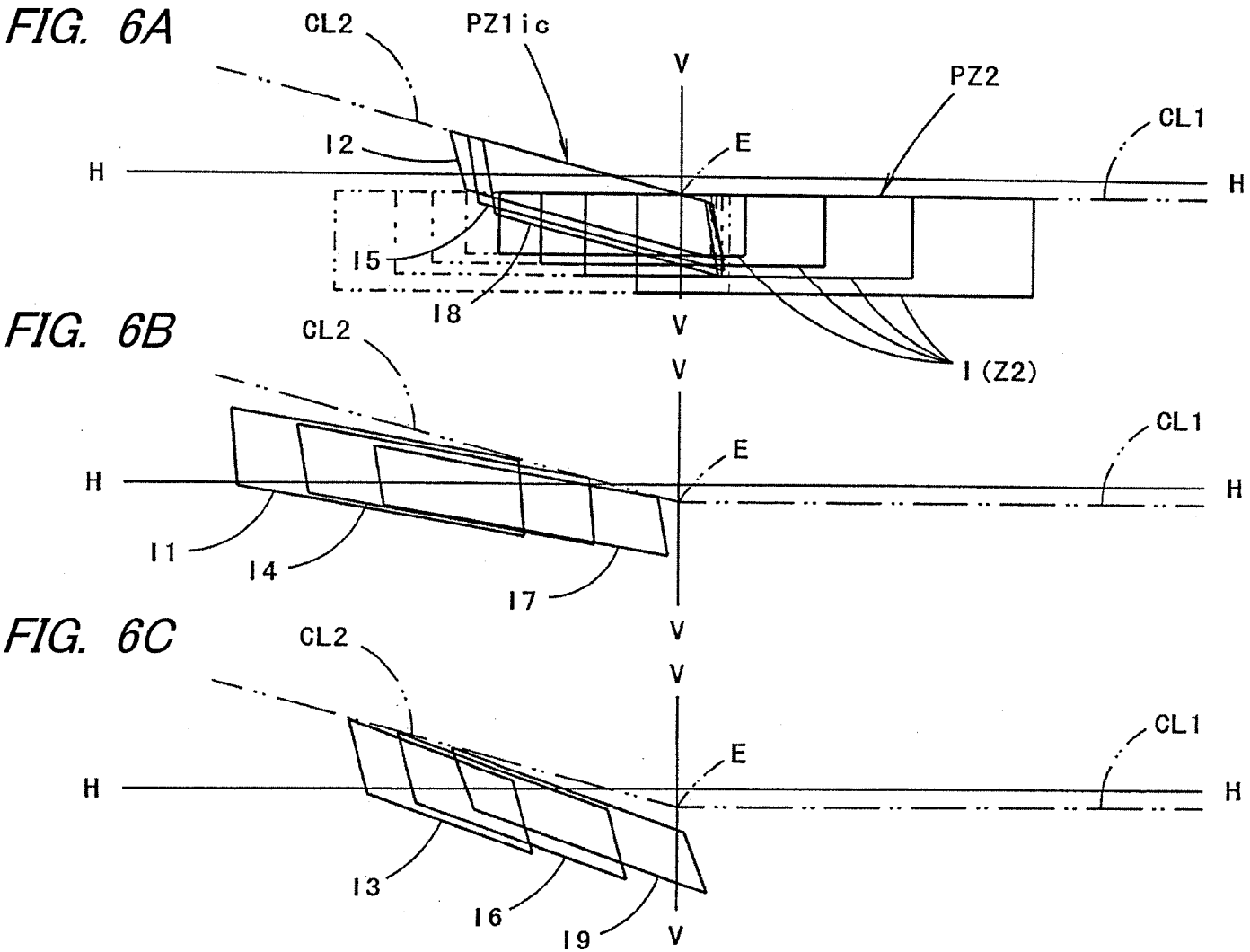
FIGS. 6A to 6C are diagrams illustrating light source images forming the low beam light distribution pattern.

FIGS. 6A to 6C are views showing a plurality of light source images I1 to I9 constituting the light distribution pattern PZ1 and a plurality of light source images I (Z2) constituting the light distribution pattern PZ2.

Since the zone Z1*ic* of the inner zone Z1*i* adjacent to the curve line C1 is formed on and along the paraboloidal reference surface P, as shown in FIG. 6A, the light source images I2, I5 and I8 (that is, the light source images, the upper lines of which have an inclination angle of 15°) formed by the repeatedly reflected light from the zone Z1*ic* are formed at the same positions as those shown in FIGS. 5D to 5F. The light source images I2, I5 and I8 are then superimposed. As a result, the light distribution pattern PZ1*ic* having a clear bright-dark border at the upper line thereof is formed, and the oblique cutoff line CL2 is formed clearly by the upper line.

The center position of the light distribution pattern PZ1*ic* in the left-right direction is slightly displaced to the ongoing lane side with respect to the line V-V because the light emitting surface 12A is disposed at a position slightly displaced to the oncoming lane side with respect to the optical axis Ax.

The zone other than the zone Z1*ic* of the inner zone Z1*i* adjacent to the curve line C1 includes the plurality of deflective reflecting-elements 14*s*1*i* formed on the paraboloidal reference surface P. Hence, as shown in FIG. 6B, the light source images I1, I4 and I7 (that is, the light source images, the upper lines of which have an inclination angle of less than 15°) formed by the repeatedly reflected light from this zone are formed at positions displaced to the ongoing lane side from the positions shown in FIGS. 5D to 5F. The deflection angles of the respective deflective reflecting-elements 14*s*1*i* are set so that the end points of the upper lines of the light source images I1, I4 and I7 on the oncoming lane side are arranged at positions being different from one another on the oblique cutoff line CL2.

The outer zone Z1*o* includes the plurality of deflective reflecting-elements 14*s*1*o* formed on the paraboloidal reference surface P. Hence, as shown in FIG. 6C, the light source images I3, I6 and I9 (that is, the light source images, the upper lines of which have an inclination angle of more than 15°) formed by the repeatedly reflected light from the outer zone Z1*o* are formed at positions displaced to the ongoing lane side from the positions shown in FIGS. 5D to 5F. The deflection angles of the respective deflective reflecting-elements 14*s*1*o* are set so that the end points of the upper lines of the light source images I3, I6 and I9 on the ongoing lane side are disposed at positions being different from one another on the oblique cutoff line CL2.

Furthermore, the light distribution pattern PZ1 formed by the repeatedly reflected light from the first zone Z1 has a clear bright-dark border at the upper line thereof by virtue of the light distribution pattern PZ1*ic* formed by the repeatedly reflected light from the zone Z1*ic* of the inner zone Z1*i* adjacent to the curve line C1. To this light distribution pattern are added the light distribution patterns formed by the light reflected by the other zone of the inner zone Z1*i* and from the outer zone Z1*o*. As a whole, the oblique cutoff line CL2 is formed clearly, and a light distribution pattern for brightly illuminating the area in the vicinity of the lower portion of the oblique cutoff line CL2 is obtained.

Next, the light distribution pattern PZ2 will be described below.

The light distribution pattern PZ2 is a light distribution pattern slenderly extending along the horizontal cutoff line CL1, and its upper line is formed as a clear bright-dark border. The reason for this will be described below.

That is, the bottom side edge 12A1 of the light emitting surface 12A is positioned on and along the horizontal plane including the optical axis Ax. Furthermore, the second zone Z2 extends in a laterally long band-like shape centered at the horizontal plane including the optical axis Ax on the lateral sides with respect to the optical axis Ax. When it is assumed that the second zone Z2 is formed on and along the paraboloidal reference surface P, the plurality of light source images I (Z2) formed by the repeatedly reflected light from the second zone Z2 are formed at positions slightly away from the line V-V to the ongoing lane side while the upper lines thereof are positioned on the same horizontal plane as indicated by two-dot chain lines in FIG. 6A.

In reality, however, in the second zone Z2, the plurality of deflective reflecting-elements 14*s*2 are formed to deflect and reflect the internally reflected light entering from the front surface 14*a* to the zone toward the oncoming lane side with respect to the direction parallel with the optical axis Ax. Hence, the plurality of light source images I (Z2) are formed at positions displaced from the positions indicated by the two-dot chain lines toward the oncoming lane side as indicated by solid lines in FIG. 6A. The deflection angles of the respective deflective reflecting-elements 14*s*2 are set so that the plurality of light source images I (Z2) are arranged at positions being different from one another on the horizontal cutoff line CL1.

Next, the light distribution patterns PZ3 and PZ4 shown in FIG. 4 will be described below.

The light distribution pattern PZ3 is a light distribution pattern formed by the repeatedly reflected light from the third zone Z3, and the light distribution pattern PZ4 is a light distribution pattern formed by the repeatedly reflected light from the fourth zone Z4. These are formed as light distribution patterns having a nearly identical shape.

These light distribution patterns PZ3 and PZ4 are formed as light distribution patterns slenderly extending in the horizontal direction along the horizontal cutoff line CL1 and being larger than the light distribution pattern PZ2. The light distribution patterns PZ3 and PZ4 have a relatively clear bright-dark border on the upper lines thereof.

This is based on the fact that the repeatedly reflected light from each of the third and fourth zones Z3 and Z4 is processed as described below. In the up-down direction, the light from the bottom side edge 12A1 of the light emitting surface 12A becomes light parallel to the optical axis Ax, and the light from the other portions of the light emitting surface 12A becomes light directed downward with respect to the optical axis Ax. Furthermore, in the horizontal direction, the light from the light emitting surface 12A is diffused to both the left and right sides by the plurality of diffusive reflecting-elements 14*s*3 and 14*s*4.

The center position of each of the light distribution patterns PZ3 and PZ4 in the left-right direction is slightly displaced to the ongoing lane side with respect to the line V-V because the light emitting surface 12A is disposed at a position slightly displaced to the oncoming lane side with respect to the optical axis Ax.

Furthermore, the horizontal cutoff line CL1 is formed subsidiarily by the upper lines of the light distribution patterns PZ3 and PZ4 as described above.

As detailed above, the vehicle lamp unit 10 is configured such that the light emitted from the light emitting device 12 disposed adjacent to the base point A on the optical axis Ax extending in the front-rear direction of the lamp and entered the transparent member 14 disposed in front of the light emitting device 12 is internally reflected by the front surface 14*a* of the transparent member 14, and the light reflected by the front surface 14*a* is then internally reflected again by the rear surface 14*b* and is emitted from the front surface 14*a*. Since the light emitting device 12 is disposed such that the bottom side edge 12A1 of the light emitting surface 12A is positioned on and along the horizontal line perpendicular to the optical axis Ax, a light distribution pattern having the horizontal cutoff line CL1 at the upper line thereof can be formed easily.

Furthermore, the front surface 14*a* of the transparent member 14 is a flat surface facing obliquely upward and including the horizontal line perpendicular to the optical axis Ax. Moreover, the rear surface 14*b* includes the light reflection control surface configured based on the paraboloidal reference surface P having the focal point F at the position symmetric with the base point A with respect to the front surface 14*a* of the transparent member 14 and having the center axis Ax1 inclined upward and forward with respect to the optical axis Ax. Hence, it is possible to find, on the paraboloidal reference surface P, a specific position wherein the light source image of the light emitting surface 12A of the light emitting device 12 formed by the light reflected by the paraboloidal reference surface P becomes a light source image having an upper line extending obliquely upward to the ongoing lane side.

Specifically, it was found that, in the rear surface 14*b* of the transparent member 14, the specific position is on the curve line C1 that is convex toward the optical axis Ax when observed from the front of the lamp in the first zone Z1 positioned obliquely downward on the ongoing lane side with respect to the optical axis Ax.

On the basis of this finding, in the rear surface 14*b* of the transparent member 14, the zone Z1*ic* of the inner zone Z1*i* of the first zone Z1 adjacent to the curve line C1 is formed as a zone in which the oblique cutoff line CL2 extending obliquely upward to the ongoing lane side is formed by the light reflected by the zone Z1*ic*, whereby the vehicle lamp unit 10 according to one or more embodiments of the present invention can clearly form the oblique cutoff line CL2.

Furthermore, in the rear surface 14*b* of the transparent member 14, the second zone Z2 positioned on the horizontal plane including the optical axis Ax is configured to reflect light to form the horizontal cutoff line CL1 extending in the horizontal direction, whereby the lamp unit 10 provides the following effects.

That is, in the lamp unit 10, the light emitting device 12 is disposed such that the bottom side edge 12A1 of the light emitting surface 12A is positioned on and along the horizontal line perpendicular to the optical axis Ax as described above. Hence, a light distribution pattern having the horizontal cutoff line CL1 at the upper end portion thereof can be formed easily. However, in the case that the second zone Z2 is formed on and along the paraboloidal reference surface P, the upper lines of the light source images I (Z2) of the light emitting surface 12A formed by the light reflected by the second zone Z2 positioned in the vicinity of the horizontal plane including the optical axis Ax are positioned on nearly the same horizontal plane. For this reason, the horizontal cutoff line CL1 can be formed clearly by selecting the second zone Z2 as a zone in which the horizontal cutoff line CL1 is formed by the light reflected by the second zone Z2.

Furthermore, the front surface 14*a* of the transparent member 14 of the lamp unit 10 is a flat surface facing obliquely upward and including the horizontal line perpendicular to the optical axis Ax. Therefore, flexibility of layout of the lamp unit 10 behind the rearwardly slanted transparent cover 50 is improved.

With one or more embodiments of the present invention, in the vehicle lamp unit 10 configured such that the light from the light emitting device 12 is emitted forward from the transparent member 14 disposed in front of the light emitting device 12, the low beam light distribution pattern PL1 having the horizontal and oblique cutoff lines CL1 and CL2 can be formed by the irradiation light of the lamp. In addition, the horizontal and oblique cutoff lines CL1 and CL2 can be formed clearly, and the degree of freedom of the layout of the lamp can be enhanced.

Furthermore, with one or more embodiments of the present invention, in the light distribution pattern PZ1 formed by the repeatedly reflected light from the first zone Z1, the light distribution patterns formed along the oblique cutoff line CL2 by the light reflected by the other zone of the inner zone Z1*i* and from the outer zone Z1*o* are added to the light distribution pattern PZ1*ic* formed by the repeatedly reflected light from the zone Z1*ic* of the inner zone Z1*i* adjacent to the curve line C1. Hence, while the oblique cutoff line CL2 is formed clearly, the area in the vicinity of the lower portion of the oblique cutoff line CL2 can be illuminated brightly. As a result, it is possible to securely obtain sufficient brightness around the hot zone HZ.

With one or more embodiments of the present invention, the light emitting device 12 is disposed such that the end point B of the bottom side edge 12A1 of the light emitting surface 12A thereof on the ongoing lane side is disposed at a portion on the ongoing lane side from the optical axis Ax and near the optical axis Ax. Hence, the light source image formed by the light reflected by the inner zone Z1*i* of the first zone Z1 serving as a zone in which the oblique cutoff line CL2 is formed can be formed at a position in the vicinity of the elbow point E on the ongoing lane side. As a result, it is possible to form the hot zone HZ of the low beam light distribution pattern PL1 at an appropriate position.

Furthermore, with the light emitting device 12 disposed as described above, the light source images I (Z2) that is formed by the light reflected by the second zone Z2 in which the horizontal cutoff line CL1 is formed can also be formed at positions in the vicinity of the elbow point E on the ongoing lane side in the case that the second zone Z2 is formed on and along the paraboloidal reference surface P. Moreover, in one or more embodiments of the present invention, the surface shape of the second zone Z2 is formed so that the light source images I (Z2) are displaced appropriately to the ongoing lane side. Hence, the horizontal cutoff line CL1 can be formed clearly and the hot zone HZ can securely obtain sufficient luminance.

In the case that a light distribution pattern PA having a large diffusion angle in the left-right direction is formed additionally on the lower side of the horizontal cutoff line CL1 by irradiation light from another vehicle lamp unit (not shown) as indicated by two-dot chain lines in FIG. 4, the luminance around the peripheral area of the low beam light distribution pattern PL1 can be increased.

Next, one or more embodiments of the present invention will be described below with reference to FIGS. 7 and 8.

Figure 7:
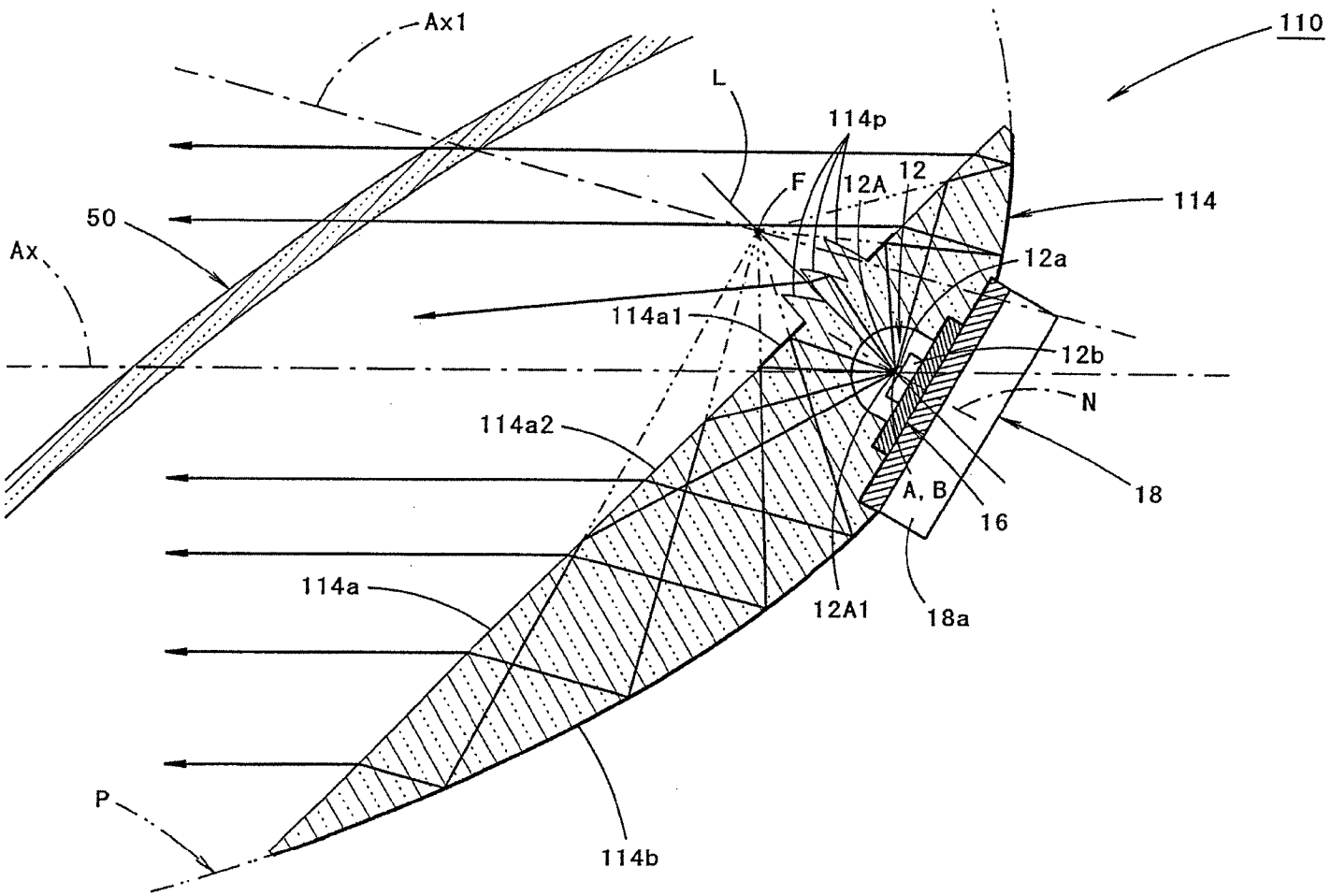
FIG. 7 is a sectional view of a vehicle lamp unit according to one or more embodiments of the present invention.

As shown in FIG. 7, the basic configuration of a vehicle lamp unit 110 according to one or more embodiments of the present invention is similar to that of the vehicle lamp unit 10 described above, but the configuration of a front surface 114*a* of a transparent member 114 of the lamp unit 110 is partially different.

More specifically, the transparent member 114 is similar to the transparent member 14 with respect to the boundary between the central area 114*a*1 and the peripheral area 114*a*2 of the front surface 114*a*. However, the central area 114*a*1 is an annular area centered at the optical axis Ax, and the area on and near the optical axis and on an inner side of the annular central area 114*a*1 is formed as a prism portion 114*p* via which the light emitted from the light emitting device 12 and having reached this area is deflected and emitted.

The prism portion 114*p* includes a plurality of prism elements arranged in a stepped manner one above the other. The light from the base point A is totally reflected by the prism elements and is emitted forward.

The prism portion 114*p* is configured such that the light emitted from the light emitting device 12 (the light from the base point A) and having reached the prism portion 114*p* is emitted from the respective prism elements as parallel light directed slightly downward with respect to the direction parallel to the optical axis Ax and toward the optical axis Ax when viewed in the vertical plane, and as diffused light directed toward both the left and right sides from the optical axis Ax when viewed in the horizontal plane.

Figure 8:
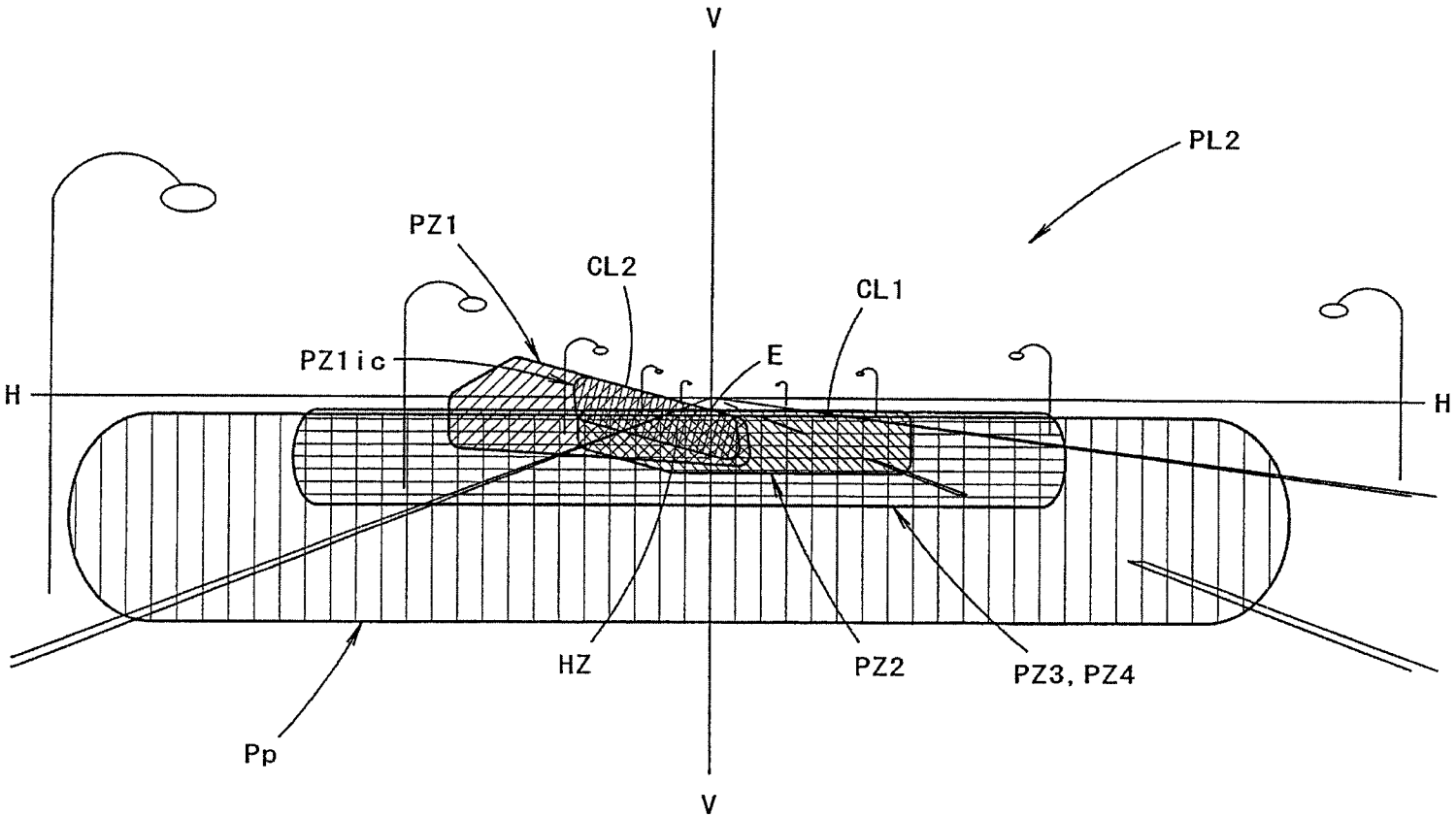
FIG. 8 is a diagram illustrating a low beam light distribution pattern formed by the lamp unit of FIG. 7.

FIG. 8 is a perspective view showing a low beam light distribution pattern PL2 formed on the imaginary vertical screen disposed 25 m ahead of the lamp by the light emitted forward from the vehicle lamp unit 110.

As shown in FIG. 8, this low beam light distribution pattern PL2 is a light distribution pattern obtained by adding a light distribution pattern Pp to the low beam light distribution pattern PL1 shown in FIG. 4.

This added light distribution pattern Pp is a light distribution pattern formed by the light directly emitted from the prism portion 114*p* on the front surface 114*a* of the transparent member 114 (hereafter "directly emitted light").

The light distribution pattern Pp is formed as a laterally long light distribution pattern extending in the horizontal direction on the lower side of the horizontal cutoff line CL1. The center position of the light distribution pattern Pp in the left-right direction is slightly displaced to the ongoing lane side with respect to the line V-V because the light emitting surface 12A is disposed at a position slightly displaced to the oncoming lane side with respect to the optical axis Ax.

The light distribution pattern PL2 according to this modification example is formed by adding the light distribution pattern Pp formed by the directly emitted light from the prism portion 114*p* to the light distribution patterns PZ1 to PZ4 formed by the light internally reflected by the rear surface 114*b* of the transparent member 114. Hence, the light flux of the light source can be used effectively.

Furthermore, the prism portion 114*p* is configured such that the light from the light emitting device 12 is emitted as light diffused in the left-right direction. Hence, the light distribution pattern Pp being relatively dark and large is formed as a laterally long light distribution pattern around the light distribution patterns PZ1 to PZ4 being relatively bright and small and formed by the light internally reflected by the rear surface 114*b* of the transparent member 114. As a result, the low beam light distribution pattern PL2 formed by the irradiation light from the vehicle lamp unit 110 can be formed as a light distribution pattern having little unevenness in light distribution.

In one or more embodiments of the present invention above, it is described that the light emitting device 12 has the light emitting surface 12A having a laterally-long rectangular shape. However, the light emitting device 12 can be configured so as to have the light emitting surface 12A having a shape other than the rectangular shape, as a matter of course.

In one or more embodiments of the present invention above, it is described that only the zone Z1*ic* of the inner zone Z1*i* of the first zone Z1 adjacent to the curve line C1 is formed on and along the paraboloidal reference surface P. However, it may be possible that the entire inner zone Z1*i* of the first zone Z1 is formed on and along the paraboloidal reference surface P.

In one or more embodiments of the present invention above, it is described that the rear surface 14*b* of the transparent member 14 excluding the area around the normal line N is entirely subjected to mirror finishing. However, since the lower area of the rear surface 14*b* can internally reflect light by total reflection, the lower area of the rear surface 14*b* can also be formed so as not to be subjected to mirror finishing.

In one or more embodiments of the present invention above, it is described that the second zone Z2 of the rear surface 14*b* of the transparent member 14 is disposed on the lateral sides of the rear surface on the ongoing lane side and on the ongoing lane side with respect to the optical axis Ax. However, the second zone Z2 can also be configured so as to be disposed only on the ongoing lane side or only on the on the oncoming lane side.

In one or more embodiments of the present invention above, it is described that the upward angle of the center axis Ax1 of the paraboloidal reference surface P is set to a value so that when it is assumed that the rear surface 14*b* of the transparent member 14 is formed on and along the paraboloidal reference surface P, the light from the base point A, which is reflected again by the rear surface 14*b* in the direction parallel with the center axis Ax1, is refracted at the front surface 14*a* and emitted in the direction parallel with the optical axis Ax. However, it is possible to adopt a configuration in which the upward angle of the center axis Ax1 is set to a value so that the light emitted from the front surface 14*a* of the transparent member 14 is directed upward or downward with respect to the direction parallel with the optical axis Ax.

While description has been made in connection with embodiments of the present invention, it will be obvious to those skilled in the art that various changes and modification may be made therein without departing from the present invention as defined by the appended claims. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle lamp unit comprising:

a light emitting device disposed adjacent to a base point on an optical axis extending in a front-rear direction of a vehicle on which the vehicle lamp unit is mounted; and a transparent member disposed in front of the light emitting device, wherein the light emitting device comprises a light emitting surface arranged to face forward, wherein the transparent member is configured such that light emitted by the light emitting device enters the transparent member and is internally reflected by a front surface of the transparent member, and such that the light reflected by the front surface is internally reflected again by a rear surface of the transparent member and emitted from the front surface of the transparent member, wherein the light emitting surface comprises a straight bottom side edge disposed on and along a horizontal line perpendicular to the optical axis, wherein the front surface of the transparent member comprises a flat surface facing obliquely upward and including another horizontal line perpendicular to the optical axis, wherein the rear surface of the transparent member comprises a light reflection control surface configured based on a paraboloidal reference surface having a focal point at a position symmetric with the base point with respect to the flat surface and having a center axis directed forward and inclined upward with respect to the optical axis, wherein a central area of the front surface has a range centered at the optical axis and is a mirrored surface, wherein the light reflection control surface is a mirrored surface, wherein the light reflection control surface comprises a first zone positioned obliquely downward on an ongoing lane side with respect to the optical axis, wherein the first zone is divided into an inner zone and an outer zone by a curve line, the curve line being convex toward the optical axis when observed from a front of the vehicle, and wherein the inner zone is configured to reflect light to form an oblique cutoff line extending obliquely upward on the ongoing lane side.

2. The vehicle lamp unit according to claim 1, wherein the light reflection control surface further comprises a second zone positioned on a horizontal plane including the optical axis, and the second zone is configured to reflect light to form a horizontal cutoff line extending in the horizontal direction.

3. The vehicle lamp unit according to claim 1, wherein an end point of the bottom side edge of the light emitting surface on the ongoing lane side is disposed at a position on the ongoing lane side from the optical axis and near the optical axis.

4. The vehicle lamp unit according to claim 1, wherein the central area of the front surface is an annular area centered at the optical axis, and an area of the front surface on an inner side of the annular area is configured as a prism portion via which light is emitted in a deflected manner toward the optical axis when viewed in a vertical plane.

5. The vehicle lamp unit according to claim 1, wherein the light emitting device comprises a plurality of light emitting chips disposed in series in the horizontal direction.

6. The vehicle lamp unit according to claim 5, wherein the plurality of light emitting chips are disposed so as to make nearly close contact with one another and front surfaces thereof are sealed with a thin film, whereby the light emitting surface for emitting light having a laterally-long rectangular shape when observed from the front of the vehicle is formed.

* * * * *